United States Patent [19]

Montfort, Jr. et al.

[11] Patent Number: 4,817,722

[45] Date of Patent: Apr. 4, 1989

[54] AUTOMATIC WELL TREATMENT METHOD

[75] Inventors: Ralph R. Montfort, Jr., Houston; James J. Moran, Sugarland, both of Tex.

[73] Assignee: Nalco Chemical Company, Naperville, Ill.

[21] Appl. No.: 41,851

[22] Filed: Apr. 23, 1987

[51] Int. Cl.[4] ..... E21B 43/12

[52] U.S. Cl. ..... 166/310; 166/902; 166/64

[58] Field of Search ..... 166/310, 312, 305.1, 166/902, 53, 64, 67, 68; 251/114

[56] References Cited

U.S. PATENT DOCUMENTS

| | | | |
|---|---|---|---|
| Re. 32,304 | 12/1986 | Maxwell | 166/53 |
| 4,132,268 | 1/1979 | Harrison | 166/244 |
| 4,375,833 | 3/1983 | Meadows | 166/64 |
| 4,436,148 | 3/1984 | Maxwell | 166/53 |
| 4,681,167 | 7/1987 | Soderberg | 166/53 |

*Primary Examiner*—Jerome W. Massie
*Assistant Examiner*—William P. Nender
*Attorney, Agent, or Firm*—Hosier & Sufrin

[57] ABSTRACT

A method and apparatus for treating oil and gas wells by automatically pre-flushing the well casing annulus with production fluid, pumping treatment chemicals into a rapidly flowing production fluid line for uniform mixing and introduction into the casing annulus, and post-flushing with production fluid.

2 Claims, 1 Drawing Sheet

AUTOMATIC WELL TREATMENT METHOD

BACKGROUND OF THE INVENTION

This invention relates generally to the introduction of treatment chemicals to oil and gas wells and, more particularly, to automatic periodic treatment of oil and gas wells by precisely metering and dispersing tretment chemicals into a production fluid flush of the well pumping system.

A variety of corrosive materials are present in the well fluid of producing oil and gas wells. These corrosive materials can cause damage to various metallic components of the wells, including particularly the production tubing. Treatment chemicals are commonly introduced to slow the rate of corrosion and thereby extend the lifetime of the pumping equipment and reduce well downtime.

In addition to corrosion problems, producing wells are sometimes subject to the build-up of paraffin which clogs the well tubing, flow lines and other parts of the well. As with the undesirable corrosion of the pumping equipment, paraffin build-up in the tubing may also be countered by introducing appropriate treatment chemicals. In addition, it may be necessary to introduce other treatment chemicals to selected wells to inhibit or alleviate other problems encountered in day-to-day operation of those wells.

There are several methods presently in use for chemically treating producing oil and gas wells. One method is to continuously pump a very small amount of the treatment chemicals into the well during the well production. The treatment chemical thus falls to the bottom of the well where it mixes with other fluids and is drawn up through the pumping system. This continuous treatment approach, unfortunately, uses unnecessarily large amounts of the treatment chemicals, and is therefore uneconomic and undesirable.

Another current treatment method involves introducing large slugs of the treatment chemicals to the well on a periodic basis, followed by slugs of liquid directly behind the chemical treatment slugs. This approach has been utilized both on a continuous basis in automatic apparatus and on a periodic basis whereby a truck containing the treatment chemicals visits the well from time to time to introduce the chemical treatment slug.

These prior art approaches are, unfortunately, less than ideal since significant amounts of the slug of treatment chemical are coated on the initially encountered well surfaces, limiting the delivery of the treatment chemicals to the lower reaches of the well.

SUMMARY OF THE INVENTION

Accordingly, the principal object of the present invention is to provide a method and apparatus for automatically and periodically introducing treatment chemicals to a well whereby the treatment chemicals are uniformly diluted with production fluid before entering the well.

It is another object of the present invention to provide a method and an apparatus for periodically introducing treatment chemicals to a well whereby the treatment chemicals are effectively delivered to all parts of the well pumping system.

In one important embodiment of the present invention, the well casing annulus is flushed with production fluid, whereupon a predetermined amount of the treatment chemical is introduced into the well flow line as the production fluid flows therethrough to form a uniform dilute mixture of the treatment chemical. This uniform dilute mixture flows down the casing annulus and into the well, where it is drawn into the adduction tube and through the pump system. The various surfaces which the treatment chemical contacts obtain the anti-corrosion or other benefits of that treatment. After a predetermined period, the well casing annulus may optionally be flushed with production fluid to wash treatment chemicals left on the casing to the bottom of the well for pick-up into the adduction tube.

Other objects and features of the present invention will become apparent upon examination of the following specification and drawings, together with the claims.

BRIEF DESCRIPTION OF THE DRAWINGS

The features of this invention which are believed to be novel are set forth with particularity in the appended claims. This invention, together with its objects and advantages, may be best understood by reference to the following description, taken in conjunction with the accompanying drawing, and in which:

DESCRIPTION OF THE PREFERRED EMBODIMENTS

Figure 1:
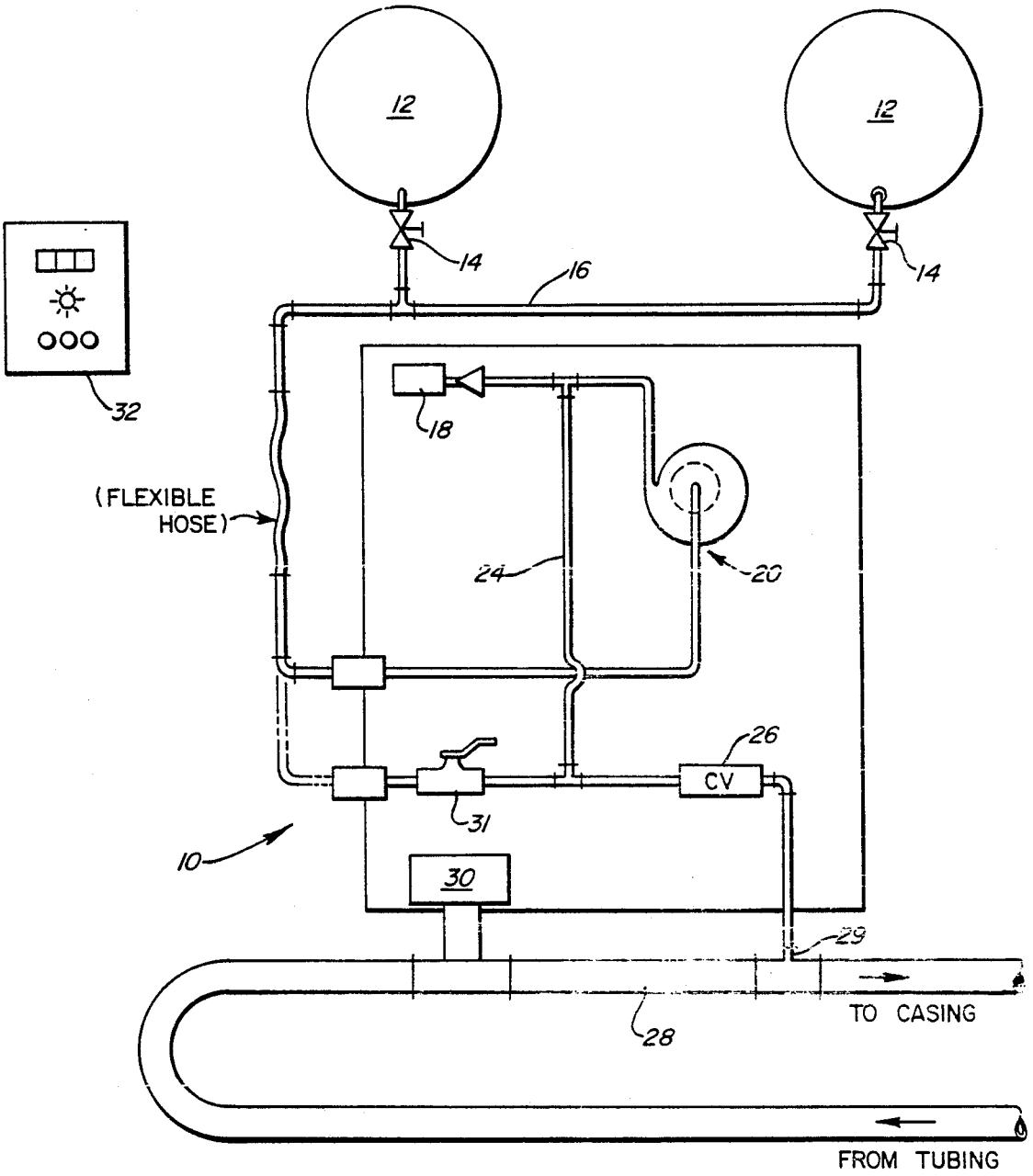
FIG. 1 is a perspective view of an apparatus for performing the method of the present invention.

Turning now to FIG. 1, there is illustrated an apparatus 10 for automatically injecting treatment chemicals into the tubing string of a production well in accordance with the present invention. Apparatus 10 includes two reservoirs for containing treatment chemicals, drums 12, with valves 14 for introducing the contents of one or both of the drums to the tubing string. A fluid line 16 runs from drums 12 and into a metering pump 20. A pressure relief valve 18 is provided to exhaust any gas or fluid which raises the pressure in the system above its pressure design limits.

Metering pump 20, in one embodiment, is a low volume, high pressure, reciprocating plunger chemical metering pump such as Pump Model No. V5-1860, available from Nalco Chemical Company of Naperville, Ill. The V5-1860 pump has a self-lubricated head, a capacity of 17.0 gallons per hour and a plunger diameter of 1 inch. It runs at 60 strokes per minute. Adjustment of the pump can be accomplished without shut-down and repeatability can be maintained down to 10% of maximum stroke.

Metering pump 20 outputs the treatment chemical through line 24 past a check valve 26 to well flow line 28 (coming from the well tubing string) at injection point 29 through which the well production fluid flows from the well tubing to the well casing in the direction indicated. Check valve 26 prevents backflow of production fluid from flow line 28 into the treatment apparatus. A motor actuated ball valve 30 is also positioned in the well flow line to open that line in conjunction with the operation of pump 20.

The opertaions of pump 20 and ball valve 30 are controlled by a programmable timer 32 which is electrically interconected with the metering pump and the ball valve (not shown) to supply current thereto for a predetermined time set by the system operator.

Apparatus 10 is operated as follows:

1. First, the operator programs timer 32 to perform the desired operations of pre-flushing well fluid through line 28, injecting chemical into the line and optionally post-flushing, all as described in greater detail below. The timer is set in terms of start time and duration of each operation and can be set for carrying out the chemical injection process once or twice a day on as many days as needed to optimize the well's response to the treatment.

2. Under the control of the timer, at the pre-selected time, motor actuated ball valve 30 opens and production fluid flows from the tubing at the well through line 28 and returns to the well, coating the casing prior to treatment.

3. After the pre-selected, pre-flush duration time, timer 32 actuates pump 20 which injects the treatment chemical into the production fluid stream which is already rapidly flowing past injection point 29. The amounts of treating chemicals are each metered out in quart equivalents. Pump 20 is calibrated to deliver 1 quart per minute and timer 32 is programmed in minutes. Pre-wet and post-flush are also programmed in minutes, to a flow rate which will vary upon the conditions encountered at the treatment site.

Injection of the treatment chemical in this fashion into the rapidly flowing production fluid passing injection point 29 causes the treatment chemical to be uniformly mixed with the production fluid. Also, if desired, additional treatment chemicals may be injected from additional chemical drums 12.

4. After the pre-selected injection time, timer 32 shuts pump 20 down and the production fluid is optionally permitted to continue to flow through the casing to flush the treatment chemical to the bottom of the well for pick-up into the adduction tube. After the pre-selected post-flush time, timer 32 shuts down motor-actuated valve 26 to complete the operation.

While particular embodiments of the invention have been shown and described, it will be obvious to those skilled in the art that various changes and modifications may be made therein without departing from the spirit and scope of the invention, and therefore, it is intended in the appended claims to cover all such changes and modifications which fall within the true spirit and scope of the invention.

What is claimed is:

1. A method for treating with a treatment chemical oil and gas wells having a flow line feeding into the well casing annulus, said method comprising the steps of:

(a) flushing the well casing annulus with production fluid of the well;

(b) forming a uniform mixture of production fluid and treatment chemical in the well flow line; and (c) introducing the mixture of production fluid and treatment chemical into the casing annulus.

2. The method of claim 1 wherein the well casing annulus is flushed with production fluid a second time to wash the mixture of production fluid and treatment chemical from the well casing annulus into the bottom of the well for pick-up during the operation of the well pump.

* * * * *